US011299991B2

(12) United States Patent
Ristau et al.

(10) Patent No.: US 11,299,991 B2
(45) Date of Patent: Apr. 12, 2022

(54) TIP SQUEALER CONFIGURATIONS

(71) Applicant: General Electric Company, Schenectady, NY (US)

(72) Inventors: Neil Devin Ristau, Simpsonville, SC (US); Michael Anthony Wondrasek, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/850,661

(22) Filed: Apr. 16, 2020

(65) Prior Publication Data

US 2021/0324746 A1 Oct. 21, 2021

(51) Int. Cl.

| | |
|---|---|
| ***F01D 5/20*** | (2006.01) |
| ***F01D 5/18*** | (2006.01) |
| ***F01D 5/14*** | (2006.01) |

(52) U.S. Cl.

CPC ..... *F01D 5/20* (2013.01); *F01D 5/189* (2013.01); *F01D 5/147* (2013.01); *F05D 2240/304* (2013.01); *F05D 2240/307* (2013.01); *F05D 2240/35* (2013.01); *F05D 2250/712* (2013.01)

(58) Field of Classification Search

CPC ..... F01D 5/20; F05D 2240/304; F05D 2240/307; F05D 2240/35; F05D 2250/712

See application file for complete search history.

(56) References Cited

U.S. PATENT DOCUMENTS

| | | | | |
|---|---|---|---|---|
| 4,390,320 | A * | 6/1983 | Eiswerth | F01D 5/005 29/889.1 |
| 5,503,527 | A * | 4/1996 | Lee | F01D 5/20 416/91 |
| 5,733,102 | A * | 3/1998 | Lee | F01D 5/20 416/97 R |
| 6,468,040 | B1 | 10/2002 | Grylls et al. | |
| 6,991,430 | B2 * | 1/2006 | Stec | F01D 5/141 415/115 |
| 7,270,514 | B2 * | 9/2007 | Lee | B23P 6/007 416/92 |
| 7,290,986 | B2 | 11/2007 | Stegemiller et al. | |
| 7,494,319 | B1 | 2/2009 | Liang | |

(Continued)

FOREIGN PATENT DOCUMENTS

| | | | |
|---|---|---|---|
| EP | 2148042 A2 | 1/2010 | |
| EP | 3444437 A1 * | 2/2019 | F01D 5/20 |

*Primary Examiner* — Courtney D Heinle
*Assistant Examiner* — Ryan C Clark
(74) *Attorney, Agent, or Firm* — Charlotte Wilson; Hoffman Warnick LLC

(57) ABSTRACT

The present embodiments set forth a blade including an airfoil including an outer tip having a floor, a leading edge and a trailing edge, a concave pressure sidewall and a convex suction sidewall extending axially between corresponding leading and trailing edges and radially between the floor and the tip cap. The airfoil further includes a tip cap extending from the floor of the outer tip and coextensive with the pressure sidewall and suction sidewall and around the leading edge and trailing edge. The tip cap includes a squealer tip configuration including a suction side tip cap portion and a pressure side tip cap portion. The suction side tip cap portion and pressure side tip cap portion extend unequal distances above the floor providing for cooling fluid flow out of the tip cap.

17 Claims, 5 Drawing Sheets

(56) References Cited

U.S. PATENT DOCUMENTS

| | | | | |
|---|---|---|---|---|
| 7,695,243 | B2 * | 4/2010 | Lee | F01D 5/188 415/121.1 |
| 7,857,587 | B2 * | 12/2010 | Correia | F01D 5/20 416/92 |
| 8,186,965 | B2 * | 5/2012 | Kuhne | F01D 5/20 416/228 |
| 8,851,833 | B2 * | 10/2014 | Diamond | F01D 5/20 415/168.2 |
| 9,273,561 | B2 * | 3/2016 | Lacy | F01D 5/20 |
| 9,822,647 | B2 | 11/2017 | Subbareddyar et al. | |
| 10,001,019 | B2 * | 6/2018 | Chouhan | F02C 3/04 |
| 10,107,108 | B2 * | 10/2018 | Jones | F02C 7/18 |
| 10,443,437 | B2 * | 10/2019 | Lacy | F01D 5/187 |
| 11,028,699 | B2 * | 6/2021 | Lee | F01D 5/186 |
| 2010/0011704 | A1 * | 1/2010 | Kester | E04C 3/07 52/831 |
| 2014/0178207 | A1 * | 6/2014 | He | F01D 11/08 416/96 R |
| 2017/0226866 | A1 | 8/2017 | Nishimura et al. | |
| 2018/0073370 | A1 * | 3/2018 | Mottram | F01D 5/186 |
| 2019/0376395 | A1 * | 12/2019 | Place | F01D 5/186 |
| 2020/0102836 | A1 * | 4/2020 | Kim | F01D 5/187 |

* cited by examiner

TIP SQUEALER CONFIGURATIONS

BACKGROUND OF THE INVENTION

The present embodiments relate generally to apparatus, methods and/or systems concerning turbine rotor blades. More specifically, but not by way of limitation, the present application relates to apparatus and assemblies pertaining to turbine rotor blades having a squealer tip configuration.

BRIEF DESCRIPTION OF THE INVENTION

The present embodiments set forth a blade including an airfoil including an outer tip having a floor, a leading edge and a trailing edge, a concave pressure sidewall and a convex suction sidewall extending axially between corresponding leading and trailing edges and radially between the floor and the tip cap. The airfoil further includes a tip cap extending from the floor of the outer tip and coextensive with the pressure sidewall and suction sidewall and around the leading edge and trailing edge. The tip cap including a squealer tip configuration to reduce overtip leakage and downstream mixing loss, and the squealer tip configuration includes a suction side tip cap portion and a pressure side tip cap portion. The pressure side tip cap portion includes a step-down section, cooling fluid flow is over the pressure side tip cap portion of the tip cap due to pressure gradients cap.

Another aspect of the embodiments sets forth a turbine engine including a blade. The blade including an airfoil including an outer tip having a floor, a leading edge and a trailing edge, a concave pressure sidewall and a convex suction sidewall extending axially between corresponding leading and trailing edges and radially between the floor and the tip cap. The airfoil further includes a tip cap extending from the floor of the outer tip and coextensive with the pressure sidewall and suction sidewall and around the leading edge and trailing edge. The tip cap including a squealer tip configuration to reduce overtip leakage and downstream mixing loss, and the squealer tip configuration includes a suction side tip cap portion and a pressure side tip cap portion. The pressure side tip cap portion includes a step-down section, cooling fluid flow is over the pressure side tip cap portion of the tip cap due to pressure gradients cap.

These and other features of the present application will become apparent upon review of the following detailed description of the preferred embodiments when taken in conjunction with the drawings and the appended claims.

The illustrative aspects of the present disclosure are developed to solve the problems herein described and/or other problems not discussed.

BRIEF DESCRIPTION OF THE DRAWINGS

These and other features of this embodiments will be more completely understood and appreciated by careful study of the following more detailed description of exemplary embodiments taken in conjunction with the accompanying drawings, in which.

Figure 1:
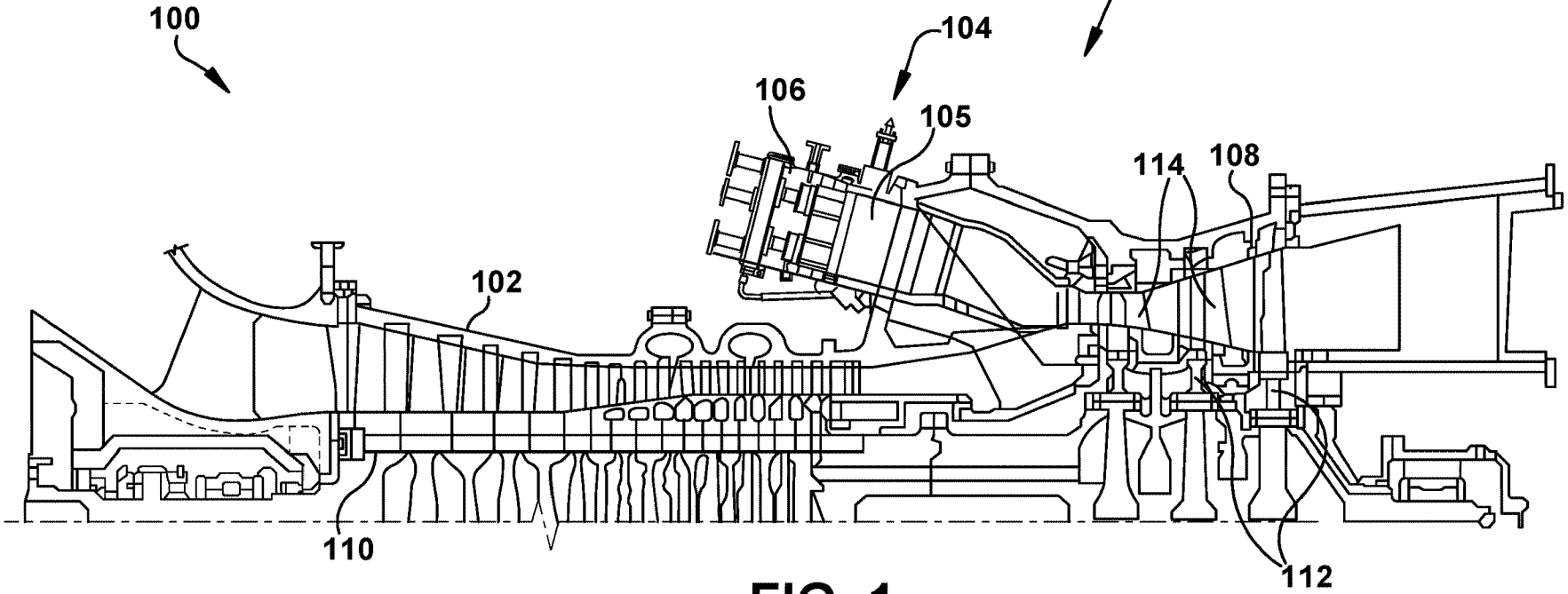
FIG. 1 is a schematic representation of an illustrative combustion turbine engine in which embodiments of the present application may be used.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

While the following examples of the present embodiments may be described in reference to particular types of turbine engines, those of ordinary skill in the art will appreciate that the present embodiments may not be limited to such use and applicable to other types of turbine engines, unless specifically limited therefrom. Further, it will be appreciated that in describing the present embodiments, certain terminology may be used to refer to certain machine components within gas turbine engines.

Whenever possible, common industry terminology will be used and employed in a manner consistent with its accepted meaning. However, such terminology should not be narrowly construed, as those of ordinary skill in the art will appreciate that often a particular machine component may be referred to using differing terminology. Additionally, what may be described herein as being single component may be referenced in another context as consisting of multiple components, or, what may be described herein as including multiple components may be referred to elsewhere as a single one. As such, in understanding the scope of the present embodiments, attention should not only be paid to the particular terminology, but also the accompanying description, context, as well as the structure, configuration, function, and/or usage of the component, particularly as may be provided in the appended claims.

Several descriptive terms may be used regularly herein, and it may be helpful to define these terms at the onset of this section. Accordingly, these terms and their definitions, unless stated otherwise, are as follows. As used herein, "downstream" and "upstream" are terms that indicate direction relative to the flow of a fluid, such as, for example, the working fluid through the compressor, combustor and turbine sections of the gas turbine, or the flow coolant through one of the component systems of the engine. The term "downstream" corresponds to the direction of fluid flow, while the term "upstream" refers to the direction opposite or against the direction of fluid flow. The terms "forward" and "aft", without any further specificity, refer to directions relative to the orientation of the gas turbine, with "forward" referring to the forward or compressor end of the engine, and "aft" referring to the aft or turbine end of the engine. Additionally, given a gas turbine engine's configuration about a central axis as well as this same type of configuration in some component systems, terms describing position relative to an axis likely will be used. In this regard, it will be appreciated that the term "radial" refers to movement or position perpendicular to an axis. Related to this, it may be required to describe relative distance from the central axis. In this case, for example, if a first component resides closer to the center axis than a second component, it will be stated herein that the first component is "radially inward" or "inboard" of the second component. If, on the other hand, the first component resides further from the axis than the second component, it may be stated herein that the first component is "radially outward" or "outboard" of the second component. Additionally, it will be appreciated that the term "axial" refers to movement or position parallel to an axis. And, finally, the term "circumferential" refers to movement or position around an axis.

Referring to the drawings, FIG. 1 is a schematic view of an illustrative turbomachine 90 in the form of a combustion turbine or gas turbine (GT) system 100 (hereinafter 'GT system 100'). GT system 100 includes a compressor 102 and a combustor 104. Combustor 104 includes a combustion region 105 and a fuel nozzle assembly 106. GT system 100 also includes a turbine 108 and a common compressor/turbine shaft 110 (hereinafter referred to as 'rotor 110'). In one embodiment, GT system 100 is a 7HA.03 engine, commercially available from General Electric Company, Boston, Mass. The present disclosure is not limited to any one particular GT system and may be implanted in connection with other engines including, for example, the other HA, F, B, LM, GT, TM and E-class engine models of General Electric Company, and engine models of other companies. Further, the teachings of the disclosure are not necessarily applicable to only a GT system, and may be applied to other types of turbomachines, e.g., steam turbines, jet engines, compressors, etc.

Figure 2:
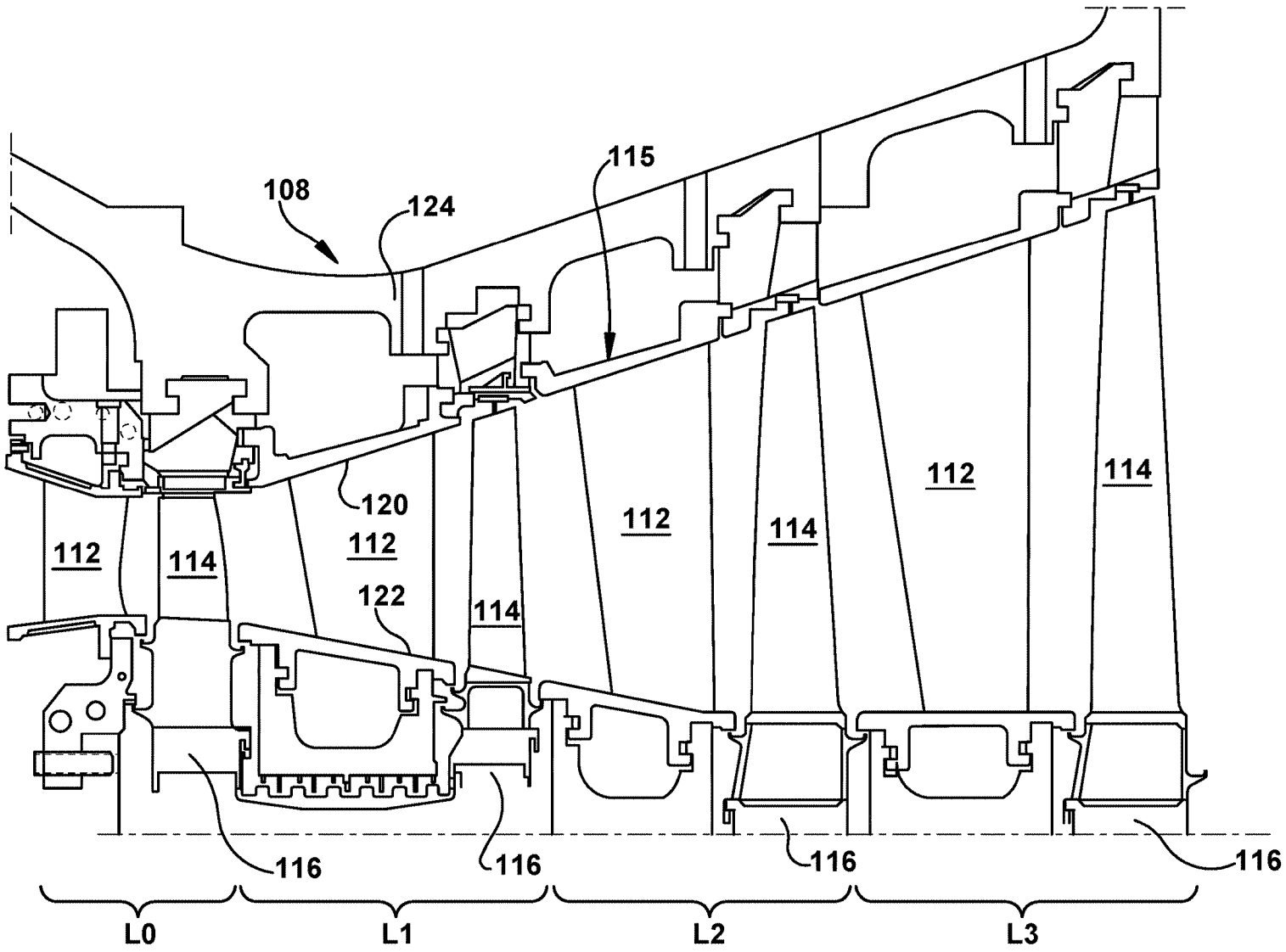
FIG. 2 is a cross-section illustration of an illustrative gas turbine assembly that may be used with the turbomachine in FIG. 1

FIG. 2 is a cross-section view of an illustrative portion of turbine 108 with illustrative and non-limiting four stages L0-L3, that are referred to as L0-L3 for descriptive purposes only and not intended to convey any structure or particular machinery, that may be used with GT system 100 in FIG. 1. The four stages are referred to as L0, L1, L2, and L3. Stage L0 is the first stage and is the smallest (in a radial direction) of the four stages. Stage L1 is the second stage and is the next stage in an axial direction. Stage L2 is the third stage and is the next stage in an axial direction. Stage L3 is the fourth, last stage and is the largest (in a radial direction). It is to be understood that four stages are shown as one example only, and each turbine may have more or less than four stages. A set of stationary vanes or nozzles 112 cooperate with a set of rotating blades 114 to form each stage L0-L3 of turbine 108, and to define a portion of a flow path through turbine 108. Rotating blades 114 in each set are coupled to a respective rotor wheel 116 that couples them circumferentially to rotor 110. That is, a plurality of rotating blades 114 is mechanically coupled in a circumferentially spaced manner to each rotor wheel 116. A static blade section 115 includes a plurality of stationary blades 112 circumferentially spaced around rotor 110. Each blade 112 may include at least one endwall (or platform) 120, 122 connected with airfoil 130. In the example shown, blade 112 includes a radially outer endwall 120 and a radially inner endwall 122. Radially outer endwall 120 couples blade(s) 112 to a casing 124 of turbine 108.

Another aspect of the disclosure provides the embodiments herein with a last stage blade of a turbomachine. The flow path on such a machine at the last stage is essentially conical, and the structure and features herein function similarly in a last stage blade with a conical flow path, as with other blade flow paths.

In operation, air flows through compressor 102 and compressed air is supplied to combustor 104. Specifically, the compressed air is supplied to fuel nozzle assembly 106 that is integral to combustor 104. Fuel nozzle assembly 106 is in flow communication with combustion region 105. Fuel nozzle assembly 106 is also in flow communication with a fuel source (not shown in FIG. 1) and channels fuel and air to combustion region 105. Combustor 104 ignites and combusts fuel. Combustor 104 is in flow communication with turbine 108 for which gas stream thermal energy is converted to mechanical rotational energy. Turbine 108 is rotatably coupled to and drives rotor 110. Compressor 102 also is rotatably coupled to rotor 110. In the illustrative embodiment, there is a plurality of combustors 104 and fuel nozzle assemblies 106. In the following discussion, unless otherwise indicated, only one of each component will be discussed. At least one end of turbine 108 may extend axially away from rotating shaft 110 and may be attached to a load or machinery (not shown) such as, but not limited to, a generator, and/or another turbine.

Figure 3:
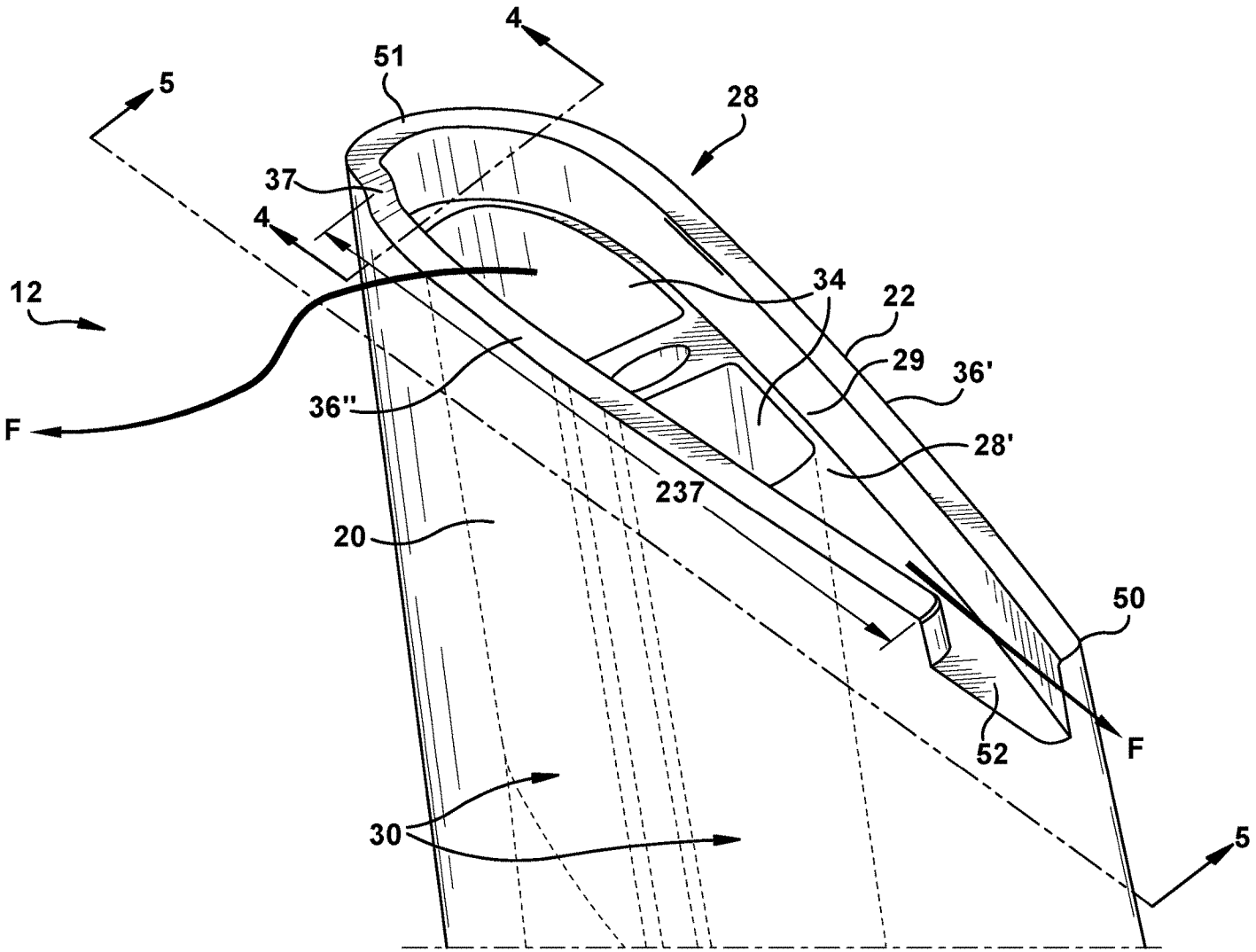
FIG. 3 is a perspective view of an exemplary rotor blade having a tip in accordance with aspects of the embodiments.

With reference to FIG. 3, blades 114 include an airfoil 12. Airfoil 12 includes a generally concave pressure sidewall 20 and an opposite, generally convex, suction sidewall 22 extending between opposite leading and trailing edges 51 and 52, respectively. Sidewalls 20 and 22 also extend in the radial direction between a root (not illustrated for ease of understanding of the embodiments) and an outer tip 28. Sidewalls 20 and 22 are spaced apart over substantially the entire span of airfoil 12 permitting cooling fluid flow as discussed hereinafter.

Airfoil 12 may have internal cooling fluid configurations. Internal cooling fluid configurations may include, for example, at least one internal flow channel 30 (illustrated in dashed lines in FIG. 3) for channeling cooling fluid air through airfoil 12, for example serpentine flow channels. Each internal cooling fluid flow channel 30 may be provided with turbulators formed therein for improving cooling fluid effectiveness (not illustrated for ease of understanding of the embodiments). Cooling fluid from each internal cooling fluid flow channel 30 may be discharged through a corresponding number of cooling fluid holes 34 (FIG. 3) at floor 128 of outer tip 28, as described hereinafter.

As in FIG. 3, airfoil 12 includes outer tip 28. The outer tip 28 includes tip cap 36, which can be integrally formed atop the radially outer ends of the pressure and suction sidewalls 20, 22. Tip cap 36 encircles an internal flow channel or cavity 29. As illustrated, tip cap 36 encircles the outer tip 28 extending from trailing edge 50 to leading edge 51.

At trailing edge 50, an opening 52 is formed in tip cap 36 at pressure side 20 proximate the trailing edge 50. Opening 52 permits cooling fluid to exit tip cap 36. Opening 52 extends from trailing edge 50 in the pressure side tip cap portion 137 towards the leading edge 51. The size of the opening 52 can vary any suitable distance along the pressure side tip cap portion 137 to permit cooling fluid to flow out of cavity 29 along with overtip leakage flow that is entrained in the squealer tip configuration by operation, where cooling fluid flow occurs by the pressure gradients inherently occurring during turbine blade and airfoil operation from the pressure to suction sides of a blade.

The tip cap 36 includes suction and pressure squealer tip configurations. The suction and pressure squealer tip configurations are formed by a suction side tip cap portion 136 and pressure side tip cap portion 137 coextensive with pressure and sidewalls 20, 22. The suction side tip cap portion 136 is provided at an elevation Y from the floor 128 of the tip cap 28, while pressure side tip cap portion 137 is provided at an altitude X from the floor 128 of outer tip 28 (see FIGS. 4 and 5). In accordance with the embodiments of the disclosure, altitude Y>altitude X. The altitude difference mitigates blade tip rubbing with the adjacent casing (not illustrated). Also, cooling fluid flow in cavity 29 at outer tip 28, regardless of origin, can exit cavity 29 through opening 52 at trailing edge 50, and also exit cavity 29 over pressure side tip cap portion 137. See arrows F in FIG. 3.

The difference in elevations Y and X is generally about less about 100 mils. In some embodiments of the disclosure difference in elevations Y and X is generally about less about 100 mils. or difference in elevations Y and X is generally about less about 90 mils or even a difference in elevations Y and X can be generally about less about 80 mils. Alternately, a difference in elevations Y and X may be generally about less about 70 mils or in some aspects, a difference in elevations Y and X may be generally about less about 60 mils. In other aspects of the instant disclosure, a difference in elevations Y and X is generally about less about 50 mils. Further, in accordance with another embodiment of the disclosure, the Y and X difference may be in a range from about 10 mils to about 50 mils, or ranges about 10 and about 50 mils, still permitting cooling fluid flow from cavity 29 through opening 52, and also from cavity 29 over pressure side tip cap portion 137, see arrows F (FIG. 3).

Figure 4:
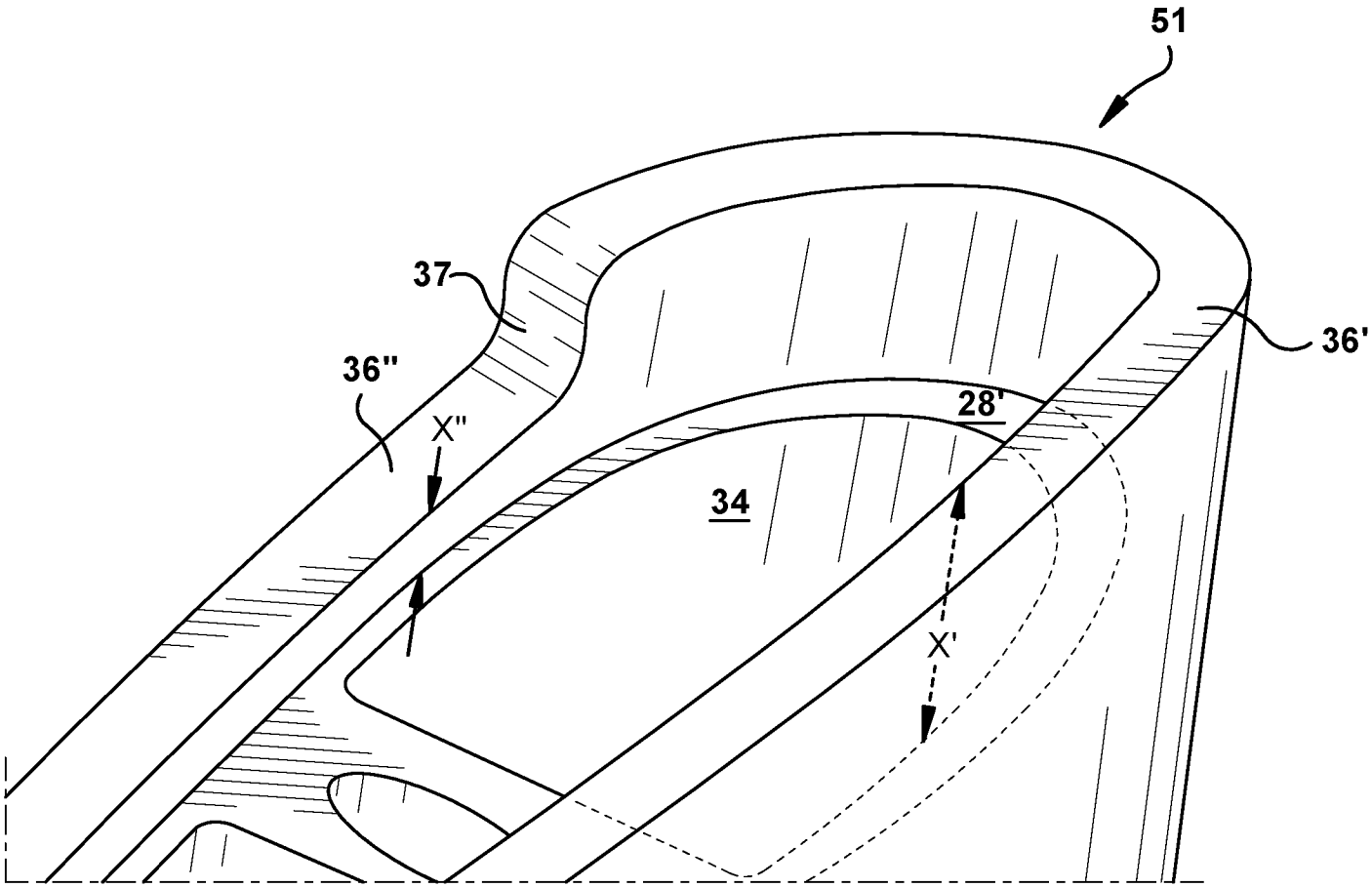
FIG. 4 is a side view of an exemplary rotor blade at the tip in accordance with aspects of the embodiments along section line 4-4.
Figure 5:
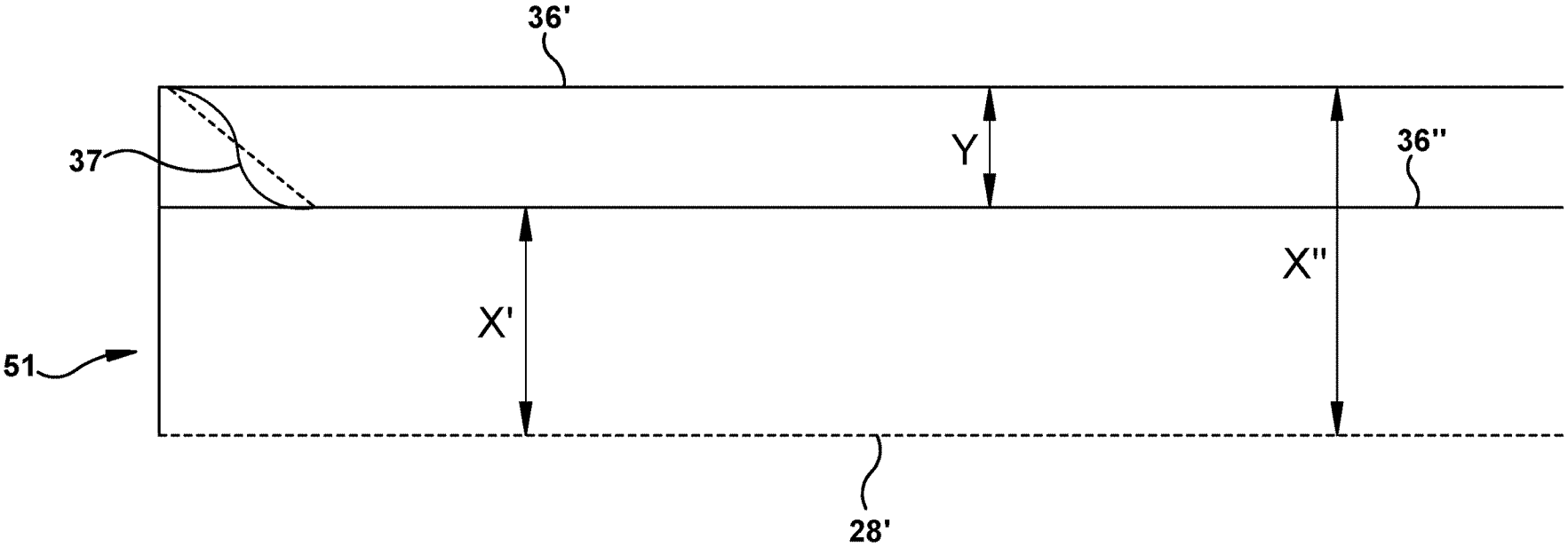
FIG. 5 is a side view of a blade in accordance with aspects of the embodiments along line 5-5.

As illustrated in FIGS. 3, 4, and 5, leading edge 51 area of tip cap 36 defines structure for the elevation change for the tip cap portions 136 and 137 to create the difference in elevations X and Y to create elevation change Z. Offset 37 provide the structure for elevation change Z. Offset 37 is illustrated as an elevational step between tip cap portions 136 and 137 at leading edge 51 area with offset 37 on pressure side tip cap portion 137. The elevation change Z puts pressure side tip cap portion 137 lower than suction side tip cap portion 136 and defines a step-down section 237 in the pressure side tip cap portion 137. Step-down section 237 extends from offset 73 to opening 52.

The configuration of offset 37 can provide physical integrity to blade 114 and airfoil 12. The configuration of offset 37 may also physically extend any suitable distance along the pressure side tip cap portion 137 that permits flow over pressure side tip cap portion 137 and also out opening 52. Step-down section 237 can extend for any portion of pressure side tip cap portion 137. Accordingly, step-down section 237 length can vary its length from offset 37 to opening 52. In one aspect of the embodiments, as per FIG. 3, offset 37 is close or at the leading edge 51 and thus step-down section 237 extends over substantially the pressure side tip cap portion 137. The further the offset 37 is from the leading edge 51 (conversely the closer the offset 37 is to trailing edge 50) will result in a shorter step-down section 237. While a short step-down section 237 will enable cooling fluid flow out of cavity 29 over the pressure side tip cap portion 137, a longer step-down section 237 provides more area for cooling fluid flow over pressure side tip cap portion 137, which of course results in enhanced cooling fluid.

Offset 37 can take any suitable configuration that provides the elevational step change/differentiation between tip cap portions 136 and 137. Offset 37 is illustrated in FIG. 5 with an orthogonal step (solid line), an angled step (dotted line), and curved line (dashed line), all of which are within the scope of the embodiments, used individually or in combination).

FIG. 5 illustrates a block diagram a side view of the airfoil 12 with offset 37 step configuration proximate leading edge 51 at line 5-5 (line 5-5 is essentially level with floor 128 of airfoil 28). Offset 37 in FIG. 5 is at leading edge 51, but that position is merely one example of the possible positions and not intended to limit the embodiments in any manner. Offset 37 may be at any portion of leading edge 51, and preferably proximate to leading edge 51, where leading edge 51 transitions to pressure side tip cap portion 137.

The offset 37 and step-down section 237 define the difference Z in elevations Y and X. The offset 37 and step-down section 237 can be formed during manufacture of airfoil 12 or formed after airfoil 12 is formed. Moreover, the suction side tip cap portion 136 and pressure side tip cap portion 137 can be added or modified once airfoil 12 has been in operation to enhance flow from the tip cap 28 and cavity 29.

It will be appreciated that, pursuant to the several embodiments discussed above, the present embodiments provide a manner by which tip cap configurations enables cooling fluid flow from a tip cap provided with a squealer tip. Additionally, the tip cap enabled by present embodiments may allow for a tighter clearance between the blade and the surrounding stationary structure. As recognized by those of skill in the art, a tighter clearance results in more motive gases being moved against airfoils and accordingly moving the airfoil's rotor to create work.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" as applied to a particular value of a range applies to both end values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A blade, the blade comprising:

an airfoil including an outer tip, the outer tip having a floor, a leading edge and a trailing edge, a concave pressure sidewall and a convex suction sidewall extending axially between corresponding leading and trailing edges and radially between the floor and the outer tip;

the airfoil further including:

a tip cap extending from the floor of the outer tip and coextensive with the pressure sidewall and suction sidewall around each of the leading edge and trailing edge, the tip cap including a squealer tip configuration to reduce overtip leakage and downstream mixing loss, and the squealer tip configuration includes a suction side tip cap portion at a first elevation and a pressure side tip cap portion at a second elevation; wherein the tip cap includes an offset providing a decreasing elevation change from the first elevation of the suction side tip cap portion to the second elevation of the pressure side tip cap portion;

wherein the suction side tip cap portion and pressure side tip cap portion extend unequal distances above the floor, wherein the pressure side tip cap portion includes the offset providing the decreasing elevation change from the first elevation of the suction side tip cap portion to the second elevation of the pressure side tip cap portion, the offset including a step-down section from the first elevation of the suction side tip cap portion to the second elevation of the pressure side tip cap portion, and cooling fluid flow is over the pressure side tip cap portion of the tip cap due to pressure gradients, wherein the step-down section of the pressure side tip cap portion extends substantially the entire pressure side tip cap portion and wherein the offset from the first elevation of the suction side tip cap portion to the second elevation of the pressure side tip cap portion is selected from at least one of a sloped decreasing elevation change, a convex curved decreasing elevation change, a concave curved decreasing elevation change, or combinations thereof.

2. The blade according to claim 1, wherein the suction side tip cap portion extends above the floor a greater distance than the pressure side tip cap portion, wherein cooling fluid flow is over of the pressure side tip cap portion of the tip cap.

3. The blade according to claim 2, wherein the offset is positioned proximate the leading edge to transition the tip cap from the suction side tip cap portion to the step-down section of the pressure side tip cap portion.

4. The blade according to claim 3, wherein the elevation change is about less about 100 mils.

5. The blade according to claim 3, wherein the elevation change is less about 50 mils.

6. The blade according to claim 3, wherein the elevation change is in a range from about 10 mils to about 50 mils.

7. The blade according to claim 3, wherein the offset is formed on one of: the pressure side tip cap portion; the leading edge; or the pressure side tip cap portion at the leading edge; or the pressure side tip cap portion proximate the leading edge.

8. The blade according to claim 1, further including an opening at the trailing edge for exhaust of cooling fluid flow.

9. The blade according to claim 8, wherein the opening is formed in the pressure side tip cap portion and extends from the trailing edge towards the leading edge.

10. The blade according to claim 1, the tip cap includes a cavity between the floor, the suction side tip cap portion, and pressure side tip cap portion; the blade including at least one internal cooling fluid passage leading to at least one corresponding cooling fluid hole in the floor.

11. The blade according to claim 10, further including an opening in tip cap for exhaust of cooling fluid flow out of the cavity, wherein the opening is formed proximate the trailing edge in the pressure side tip cap portion.

12. A turbine engine, the turbine engine comprising:

a blade, the blade including an airfoil, the airfoil including an outer tip having a floor, a leading edge and a trailing edge, a concave pressure sidewall and a convex suction sidewall extending axially between corresponding leading and trailing edges and radially between the floor and the outer tip, the airfoil further including:

a tip cap extending from the floor of the outer tip and coextensive with the pressure sidewall and suction sidewall around each of the leading edge and trailing edge, the tip cap including a squealer tip configuration, the squealer tip configuration configured to reduce overtip leakage and downstream mixing loss, and includes a suction side tip cap portion at a first elevation and a pressure side tip cap portion at a second elevation;

wherein the suction side tip cap portion and pressure side tip cap portion extend unequal distances above the floor, wherein the pressure side tip cap portion includes the offset providing the decreasing elevation change from the first elevation of the suction side tip cap portion to the second elevation of the pressure side tip cap portion, the offset including a step-down section from the first elevation of the suction side tip cap portion to the second elevation of the pressure side tip cap portion, cooling fluid flows over the pressure side tip cap portion of the tip cap due to a pressure gradient, and wherein the offset being positioned proximate the leading edge to transition the tip cap from the suction side tip cap portion to the step-down section of the pressure side tip cap portion; wherein the step-down section of the pressure side tip cap portion extends substantially the entire pressure side tip cap portion and wherein the offset from the first elevation of the suction side tip cap portion to the second elevation of the pressure side tip cap portion is selected from at least one of a sloped decreasing elevation change, a convex curved decreasing elevation change, a concave curved decreasing elevation change, or combinations thereof.

13. The turbine engine according to claim 12, wherein the elevation change is about less about 100 mils.

14. The turbine engine according to claim 12, wherein the elevation change is in a range from about 10 mils to about 50 mils.

15. The turbine engine according to claim 12, wherein the offset is formed on one of: the pressure side tip cap portion; the leading edge; or the pressure side tip cap portion at the leading edge; or the pressure side tip cap portion proximate the leading edge.

16. The turbine engine according to claim 12, further including an opening in the trailing edge for exhaust of cooling fluid flow out of the tip cap.

17. The turbine engine according to claim 12, the tip cap includes a cavity between the floor and the suction side tip cap portion and pressure side tip cap portion, the blade including at least one internal cooling fluid passage leading to corresponding at least one cooling fluid hole in the floor.

* * * * *